US006108941A

United States Patent [19]

Gillespy

[11] Patent Number: 6,108,941

[45] Date of Patent: Aug. 29, 2000

[54] CONVEYOR DRYER WITH STATIONARY CONVEYOR SUPPORT STRUCTURE

[75] Inventor: Roy J. Gillespy, Garner, N.C.

[73] Assignee: Aeroglide Corporation, Cary, N.C.

[21] Appl. No.: 09/358,968

[22] Filed: Jul. 22, 1999

[51] Int. Cl.[7] ..... F26B 25/06

[52] U.S. Cl. ..... 34/619; 34/632; 34/633; 34/634; 34/236; 34/242

[58] Field of Search ..... 34/614, 619, 623, 34/624, 632, 633, 634, 646, 649, 659, 664, 236, 242

[56] References Cited

U.S. PATENT DOCUMENTS

| | | | |
|---|---|---|---|
| 1,713,485 | 5/1929 | Alexander | 34/634 |
| 3,728,799 | 4/1973 | Streltsov | 34/151 |
| 4,067,318 | 1/1978 | Flaith et al. | 34/208 |
| 4,397,103 | 8/1983 | Ruepp | 34/155 |
| 4,419,834 | 12/1983 | Scott | 34/57 A |
| 4,622,761 | 11/1986 | Barth | 34/86 |
| 5,581,908 | 12/1996 | Theilacker | 34/634 |
| 5,946,819 | 9/1999 | Reimer et al. | 34/541 |
| 6,000,095 | 12/1999 | Johnson | 15/316.1 |
| 6,006,446 | 12/1999 | Pagendarm | 34/633 |

FOREIGN PATENT DOCUMENTS

| | | | |
|---|---|---|---|
| 000066661 A1 | 12/1982 | European Pat. Off. | 34/624 |
| 000844266 | 7/1952 | Germany | 34/632 |
| 001009562 | 11/1965 | United Kingdom | 34/633 |

*Primary Examiner*—Pamela A. Wilson
*Assistant Examiner*—Andrea M. Joyce
*Attorney, Agent, or Firm*—Coats & Bennett, PLLC

[57] ABSTRACT

A conveyor dryer having a drying chamber and a conveyor disposed within the chamber for conveying a selected material through the chamber is detected. A stationary conveyor support is disposed on each side of the conveyor for supporting the conveyor. A material guide is disposed adjacent each side of the conveyor for generally retaining material on the conveyor and wherein the conveyor support and material guide are disposed adjacent to each other such that they cooperate to form a generally air tight seal that minimizes the flow of air between the conveyor support and the material guide.

14 Claims, 3 Drawing Sheets

CONVEYOR DRYER WITH STATIONARY CONVEYOR SUPPORT STRUCTURE

FIELD OF THE INVENTION

The present invention relates to conveyor dryers of the type that are used to dry or condition various types of material.

BACKGROUND OF THE INVENTION

Conveyor dryers are widely used to dry and condition various materials and products. Typically, these conveyor dryers include a drying or conditioning chamber having a moving conveyor disposed therein. A system is incorporated into the conveyor dryer for generating conditioned or heated air that is forced through the conveyor and the material supported on the conveyor. Thus as the conveyor moves through the conditioning chamber, air moving through the conveyor and the material thereon functions to selectively dry or condition the material.

In order to drive the conveyor, a link type drive chain is secured to each side of the conveyor and driven by an electric motor. Thus as the conveyor moves through the drying chamber, the side chains typically ride on a support rail. Further, in order to seal the sides of the chamber, the conveyor carries a traveling guide that extends upwardly and moves against a stationary seal. Thus, the traveling guide and the stationary seal are designed to form a generally air tight seal and to retain product about the conveyor.

There are many drawbacks and disadvantages to conventional conveyor system designs used in conveyor dryers. For example, the structure utilized to form the seal adjacent each side of the conveyor makes wear and tear a concern. The fact that such conventional designs require a traveling guide to continuously move against a fixed seal obviously indicates that there will be a limited life to these frictionally engaging components and in the end that can result in frequent shut downs for the conveyor dryer.

SUMMARY OF THE INVENTION

The present invention entails a conveyor dryer that includes a conveyor system that includes a stationary conveyor support that supports the conveyor and also cooperates with one or more other structures to form an air tight seal.

More particularly, the present invention entails a conveyor dryer having a drying chamber and a conveyor disposed within the chamber for conveying material or product through the drying chamber. An air conditioning system for heating or conditioning the air and circulating the air through the conveyor and the material carried on the conveyor is also provided. A stationary conveyor support is disposed on each side of the conveyor for supporting the conveyor. This stationary conveyor support includes a support surface that engages a portion of the conveyor and supports the conveyor as it is pulled or moved along the conveyor supports. To retain material on the conveyor, a material guide is disposed adjacent the conveyor for generally retaining material on the conveyor as it moves through the drying chamber. The conveyor support is particularly disposed adjacent and in conjunction with the material guide such that the two components cooperate to form an air seal that minimizes the flow of air between the conveyor support and the material guide.

In one particular embodiment of the present invention, the conveyor support includes an elongated non-metallic structure disposed on each side of the conveyor that includes a slot or opening formed in the inboard side thereof. A side portion of the conveyor projects into the slot and is confined therein. In use, the conveyor is effectively moved or pulled through the inboard slots formed in the non-metallic conveyor supports. At the same time, a material guide depends downwardly and extends adjacent the elongated conveyor support in such a fashion that the conveyor support and material guide form a generally air tight seal.

It is therefore an object of the present invention to provide a conveyor dryer with a relatively simple conveyor system.

Another object of the present invention is to provide a conveyor system for a conveyor dryer that minimizes air and product leakage.

Another object of the present invention entails providing a conveyor dryer with a conveyor system that eliminates the conventional traveling guide.

Other objects and advantages of the present invention will become apparent and obvious from a study of the following description and the accompanying drawings, which are merely illustrative of such invention.

DETAILED DESCRIPTION OF THE INVENTION

Figure 1:
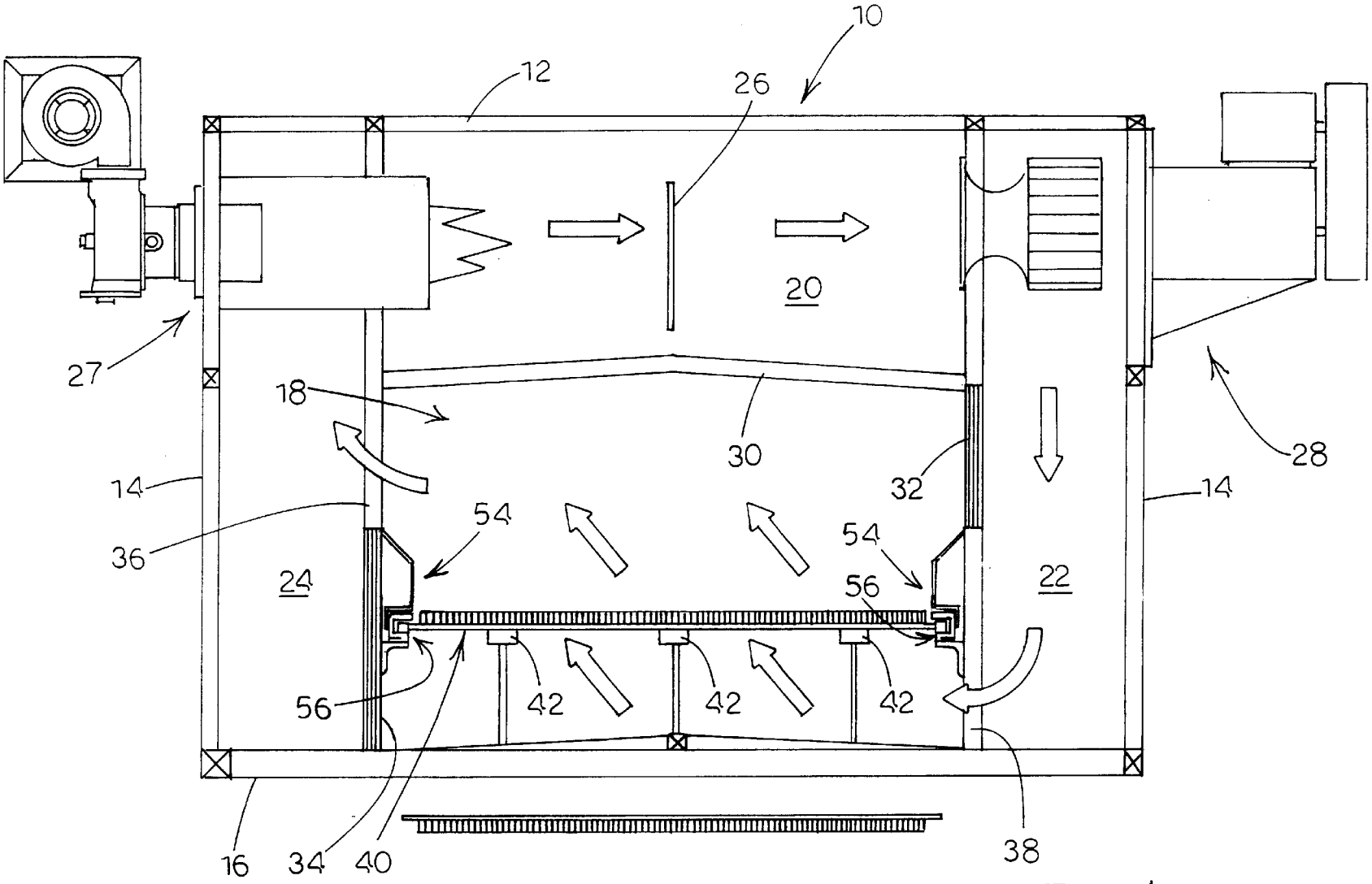
FIG. 1 is a cross sectional view of the conveyor dryer of the present invention.

With further reference to the drawings, and particularly FIG. 1, the conveyor dryer of the present invention is shown therein and indicated generally by the numeral 10. Conveyor dryer 10 basically comprises a housing structure that includes a top 12, opposed sides 14 and a bottom 16. In addition the conveyor dryer 10 includes opposed ends (not shown).

Formed internally within the conveyor dryer 10 is a drying or conditioning chamber indicated generally by the numeral 18. The drying or conditioning chamber 18 is formed or surrounded by an intermediate upper wall 30 that together with the top of the housing 12 forms an upper plenum 20. In addition the drying chamber 18 is designed so as to include a number of interchangeable panels that permit airflow to be directed in various directions through the drying chamber. In the set up illustrated in FIG. 1, there is provided an interchangeable panel 32 along the upper right side of the drying chamber 18 and an interchangeable panel 34 along the lower left side of the drying chamber. To permit air to flow through the drying chamber, there is provided an upper side opening 36 and a lower side opening 38.

The conveyor dryer also includes a system for generating and circulating a system of heated or conditioned air. In this regard, disposed about an upper side portion of the housing structure of the conveyor dryer 10 is a burner unit indicated generally by the numeral 27. Disposed opposite the burner unit 27 is a recirculation fan system 28. As illustrated in FIG. 1, the burner unit 27 generates heat and a system of air is pulled or moved across the burner unit 27 through the upper plenum 20. This system of air is directed downwardly through a side plenum 22 into and through the lower side opening 38 into the drying chamber 18. Once the system of heated or conditioned air moves through the opening 38, the air moves generally upwardly through the conveyor 40 and the material thereon and out the upper side opening 36 into side plenum 24. There the air is circulated or moved upwardly past the burner unit 27. This recirculation pattern is continued while the conveyor 40 and the material thereon move from one end of the conveyor dryer 10 to the other end. It should be appreciated that the air pattern through the drying chamber can be reversed by simply rearranging the interchangeable panels 32 and 34. For example, instead of the air being moved upwardly through the conveyor 40, by selectively rearranging the interchangeable panels, the air can be directed into the drying chamber 18 above the conveyor 40 and then downwardly through the conveyor and the material contained thereon and out a side opening underneath the conveyor after which the air is recirculated back around past the burner unit 27.

Details of the conveyor dryer 10 are not discussed herein because such is not per se material to the present invention and conveyor dryers are commercially available and their designs are appreciated by those skilled in the art. For example, conveyor dryers of the type disclosed herein are manufactured and sold by Aeroglide Corporation of Cary, N.C. 27511.

A conveyor indicated generally by the numeral 40, is disposed within the drying or conditioning chamber 18 and includes opposite side portions 40*a*. It is seen in FIG. 1 where the conveyor 40 includes an upper run disposed within the drying chamber 18 and a lower run that extends below the bottom 16 of the conveyor dryer 10. In conventional fashion, the conveyor 40 is of the endless type, such as an I-link or woven belt, and is typically driven by an electric motor or other power source from one end of the conveyor dryer.

Figures 2, 2A:
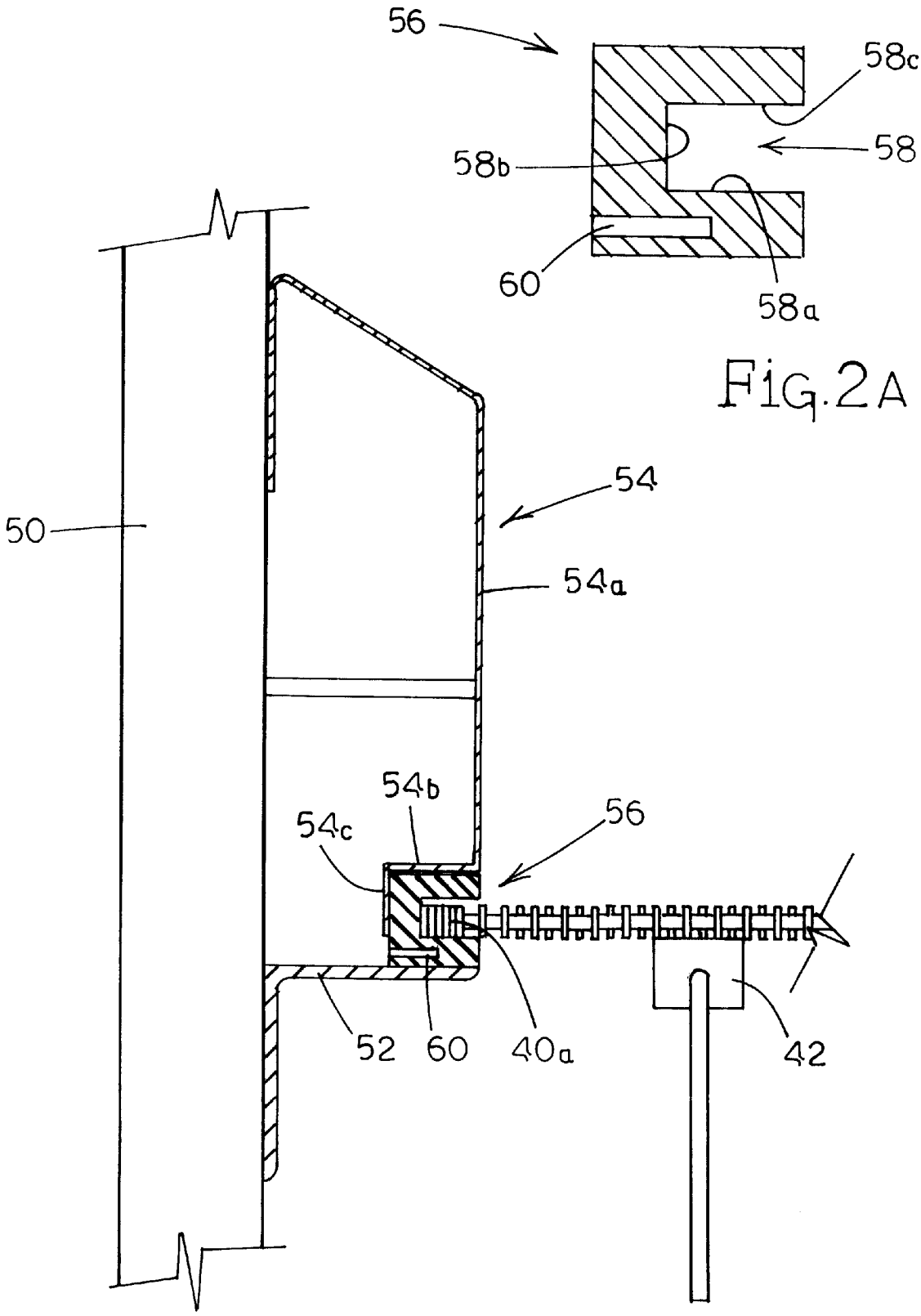
FIG. 2 is a fragmentary cross sectional view of a portion of the conveyor dryer illustrating the conveyor support system of the present invention.
FIG. 2A is a cross sectional view of the conveyor support.
Figure 3:
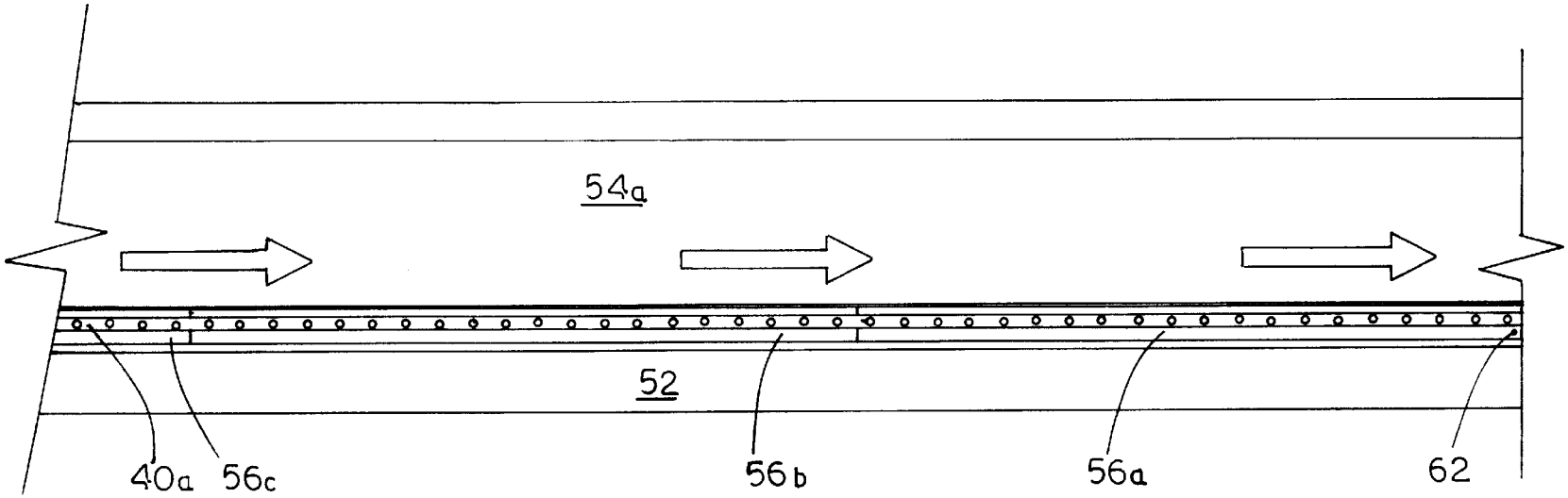
FIG. 3 is a fragmentary longitudinal sectional view showing the conveyor support system.

Turning to FIGS. 2, 2A and 3, there is shown therein a support structure for supporting the conveyor 40. With particular reference to FIG. 2, the support structure for supporting one side of the conveyor 40 is shown therein. It is understood that a like structure would be disposed on the opposite side of the drying chamber 18 for supporting the other side of the conveyor 40. Viewing the conveyor support structure as illustrated in FIG. 2, it is seen that there is provided a plurality of vertical frame members 50 that would typically be longitudinally spaced along one side of the drying chamber 18. Secured to the inboard side of the vertical frame members 50 is an elongated angle iron railing 52. The angle iron railing 52 extends from the front end to the rear end of the conveyor dryer 10. Mounted to the respective vertical frame members 50 is a material guide 54 that can be constructed of sheet metal selectively bent to yield the configuration shown in FIG. 2. Note that the material guide 54 includes a sidewall 54*a* and formed about the lower terminal end of the sidewall 54*a* is an L-shaped configuration that comprises segments 54*b* and 54*c*. Disposed below the material guide 54 and supported on the angle iron railing 52 is a conveyor support indicated generally by the numeral 56. The conveyor support 56 includes a series of elongated members aligned in end-to-end relationship along the angle iron railing. In FIG. 3, the respective sections of the conveyor support 56 are denoted by 56*a*, 56*b*, and 56*c*. As seen in FIG. 2, each section of the conveyor support 56 assumes a generally C-shaped configuration and as such is open from the inboard side. More particularly, each section of the conveyor support 56 includes an open receiving area 58 that is adapted to receive a side portion 40*a* of the conveyor. The receiving area 58 includes a base 58*a*, an end wall 58*b*, and an upper surface or wall 58*c* (FIG. 2A). Disposed below the receiving opening 58 is a wear opening 60 that is open from the outboard side of the conveyor support 56. The wear opening 60 enables one to inspect the wear of the conveyor support 56 from a position outside of the drying chamber 18.

In a preferred design, the sections that form the conveyor support 56 would be constructed of a non-metallic material such as "Teflon". Alternatively, other materials such as thermal plastic, nylon and wood could possibly be used to support the conveyor 40.

As illustrated in FIG. 2, the sections that form the conveyor support 56 serve two basic functions. First the conveyor support 56 actually receives and holds side portions 40*a* of the conveyor 40 as the conveyor is moved through the drying chamber. It is important to appreciate that the sections that comprise the conveyor support 56 are generally stationary. Thus the side portions 40*a* of the conveyor are actually pulled or moved through the receiving area 58 or slot formed in the conveyor support. More particularly, each side portion 40*a* of the conveyor lies on and frictionally engages the base 58*a* of the receiving area 58 as the conveyor is pulled or moved through the drying chamber. In addition, the sections of the conveyor support 56 serve a sealing function. As illustrated in FIG. 2 the sections of the conveyor support 56 lie under the L-shaped segments 54*b* and 54*c* of the material guide 54. In other words, the lower terminal portion of the material guide tends to wrap around the upper and outboard sides of the conveyor support 56 so as to form a generally airtight seal as well as a seal that retains material or product being conveyed on the conveyor 40. It should be appreciated that the seal formed does not form an absolute air tight seal. The use of the term "air tight" means that the seal does inhibit air from moving between the conveyor support 56 and the material guide 54 but that a small amount of leakage could be expected.

It is contemplated that in one embodiment of the present invention, that only one section of the conveyor support 56 on each side would actually be secured to an associated frame structure. In this regard and as illustrated in FIG. 3, the upstream most conveyor support section 56*a* may be pinned by a locking pin 62 to an adjacent frame structure. The trailing sections 56*b* and 56*c* of the conveyor support would simply be disposed end-to-end and would essentially be confined between the side portion 40*a* of the conveyor 40 and the lower terminal end of the material guide 54. Thus the trailing sections 56*b* and 56*c* as shown in FIG. 3 can move slightly both fore and aft and laterally back and forth.

Therefore, it is appreciated that the present design eliminates the troublesome side chains that are conventionally associated with conveyors found in conveyor dryers. In addition, the conventional traveling guide that retains material and product on the conveyor is also eliminated. In short, there are no moving parts to the conveyor support structure or to the sealing structure that extends along the sides of the conveyor.

The present invention may, of course, be carried out in other specific ways than those herein set forth without departing from the spirit and the essential characteristics of the invention. The present embodiments are therefore to be construed in all aspects as illustrative and not restrictive and all changes coming within the meaning and equivalency range of the appended claims are intended to be embraced therein.

What is claimed is:

1. A conveyor dryer, comprising:

a. a drying chamber;

b. a conveyor disposed within the chamber for conveying a selected material through the drying chamber;

c. a heating system for heating air and circulating the heated air through the conveyor and through the material carried on the conveyor;

d. a stationary conveyor support disposed on each side of the conveyor for supporting the conveyor, each conveyor support having a support surface that engages a portion of the conveyor and supports the conveyor as it moves along the conveyor supports;

e. a material guide disposed adjacent the conveyor for generally retaining material on the conveyor as it moves through the drying chamber; and f. wherein the conveyor support and the material guide are disposed adjacent each other such that they cooperate to form a generally air tight seal that minimizes the flow of air between the conveyor support and the material guide.

2. The conveyor dryer of claim 1 wherein the conveyor includes opposite side portions that are supported by the conveyor supports and wherein each conveyor support includes an inboard side that is provided with an opening for receiving a side portion of the conveyor, and wherein each side portion of the conveyor projects into the opening formed in the inboard side of the conveyor support such that the opposite side portions of the conveyor are supported within the openings formed in the inboard sides of the conveyor supports as the conveyor moves through the drying chamber.

3. The conveyor dryer of claim 2 wherein the conveyor supports assume a generally U-shaped configuration.

4. The conveyor dryer of claim 3 wherein the opening formed in the inboard side of respective conveyor supports define the support surface and, a side wall and an upper wall, and wherein as the conveyor moves through the conveyor supports, the side portions of the conveyor are confined between the support surface, side wall and upper wall.

5. The conveyor dryer of claim 4 wherein a conveyor supports are constructed of a non-metallic material.

6. The conveyor dryer of claim 5 wherein a non-metallic material is selected from the group consisting of thermal plastic, nylon and wood.

7. The conveyor dryer of claim 1 wherein the conveyor includes opposed side portions and wherein each side portion projects into an opening formed in the conveyor supports and wherein as the conveyor moves through the chamber the opposed side portions are confined within the conveyor supports.

8. The conveyor dryer of claim 1 wherein each conveyor support is formed of a non-metallic material and assumes a generally C-shaped configuration that is open on an inboard side that faces the conveyor and wherein the conveyor includes opposite side portions that are received and supported within the C-shaped configuration.

9. The conveyor dryer of claim 1 wherein each conveyor support includes a top and an outboard side and wherein the material guide depends downwardly and turns around both the top and outboard side of the respective conveyor supports so as to form the seal.

10. The conveyor dryer of claim 1 wherein the respective conveyor supports include a wear opening that enables the conveyor supports to be inspected for wear.

11. The conveyor dryer of claim 1 wherein the conveyor support disposed on each side of the conveyor includes a series of individual conveyor supports disposed end to end.

12. A conveyor dryer for at least one of drying and conditioning comprising:

a. an outer housing structure having a conditioning chamber formed therein;

b. a conveyor having opposed sides disposed within the conditioning chamber for moving a selected material through the conditioning chamber;

c. an air conditioning system for directing a system of conditioned air through the chamber and through the conveyor and material thereon; and d. a stationary conveyor support disposed on opposite sides of the conveyor for supporting the conveyor as it moves through the chamber, each conveyor support including a conveyor receiving area and wherein opposite sides of the conveyor project into the receiving area of the respective conveyor supports and are supported by the receiving area as the conveyor is pulled through the conveyor supports.

13. The conveyor dryer of claim 12 wherein each conveyor support includes an inboard side having an elongated opening formed therein through which a side of the conveyor projects and moves.

14. The conveyor dryer of claim 13 wherein the respective conveyor supports assume a generally C-shaped configuration such that the opening formed in the conveyor support is disposed on the inboard side thereof.

* * * * *